United States Patent [19]

Murayama et al.

[11] 4,076,604

[45] Feb. 28, 1978

[54] PROCESS FOR THE ELECTROLYTIC TREATMENT OF ALKALI HALIDE

[75] Inventors: Naohiro Murayama; Kenichi Nakamura; Makoto Fukuda; Teruo Sakagami; Shirou Suzuki, all of Iwaki, Japan

[73] Assignee: Kureha Kagaku Kogyo Kabushiki Kaisha, Tokyo, Japan

[21] Appl. No.: 732,095

[22] Filed: Oct. 13, 1976

[30] Foreign Application Priority Data

Oct. 13, 1975 Japan ..... 50-123078
Oct. 29, 1975 Japan ..... 50-130088

[51] Int. Cl.[2] ..... C25B 1/16; C25B 1/26
[52] U.S. Cl. ..... 204/98; 204/128
[58] Field of Search ..... 204/98, 128

[56] References Cited

U.S. PATENT DOCUMENTS 3,933,603 1/1976 Ishida et al. ..... 204/98
3,954,579 5/1976 Cook et al. ..... 204/98

*Primary Examiner*—R. L. Andrews
*Attorney, Agent, or Firm*—Fleit & Jacobson

[57] ABSTRACT

In an electrolytic treatment of alkali halide for the manufacture of alkali hydroxide, a three-chamber type reaction vessel assembly is used so as to provide an anodic chamber, an intermediate chamber and a cathodic chamber arranged in succession one after another and mutually separated by means of anodic (i.e., cationic selective) ion exchange membranes. From the intermediate chamber, low concentration caustic alkali solution is obtained, while from the cathodic chamber, high concentration caustic alkali solution is obtained. In this electrolytic process, the system is operated with the cathodic chamber supplied with no water or aqueous content. The high concentration caustic alkali solution is made from water and alkali metal ions conveyed from the intermediate chamber to the cathodic chamber and exclusively and osmotically passed through the anodic ion exchange membrane. The polymers or copolymers of the anodic ion exhange membrane include sulfonic acid, carboxylic acid and/or phenolic radicals. As the method for the introduction of these radicals, formation of corresponding copolymers may be utilized in the most recommended way. As an example, the membrane may comprise a fluorinated polymer having a cyclic ring structure unit and pendant type sulfonic acid radicals.

6 Claims, 2 Drawing Figures

PROCESS FOR THE ELECTROLYTIC TREATMENT OF ALKALI HALIDE

BACKGROUND OF THE INVENTION

This invention relates to the process for the production of high concentration caustic alkali through ion exchange membrane electrolysis from alkali halide solution at high output efficiency. As is well known, halogen, especially chlorine, and caustic alkali are basic and important materials which are used broadly in various industrial manufacturing firms.

It is also well known to use selectively operating ion-permeable membranes for the separation between the anolyte and the catholyte relating to the aqueous salt solution under electrolysis. When, however, it is desired to execute the electrolysis for the production of caustic alkali by use of a single ion-permeable membrane with 80% or still higher current efficiency, the resulting caustic alkali concentration will be 20% or so at the maximum. It is, therefore, necessary to adopt a condensing step to increase the concentration of the thus obtained caustic alkali, because consumers generally desire a highly concentrated caustic alkali for the reason of easier transportation and the like. It is nowadays, therefore, a goal of the electrolysis to obtain more than 30%, preferably 40% or so of a caustic alkali through the one time electrolysis without using a condensation step.

It is, therefore, the main object of the present invention to provide an improved electrolytic process for the manufacture of high concentration caustic alkali from aqueous lower concentration alkali halide solution using a simpler bath structure.

A further object is to provide the process of the above kind for the production of industrial caustic soda from sea water or the like low concentration brine.

For carrying out the process according to this invention, the electrolytic vessel means may preferably comprise an anodic chamber, an intermediate chamber and a cathodic chamber arranged in series one after another and separated by anodic (i.e., cationic selective) ion exchange membranes. When necessary, the intermediate chamber may be fed with water or aqueous low concentration caustic alkali solution, while the cathodic chamber is not fed with water at all, so as to provide a capability of producing high concentration caustic alkali as the product.

It has already been disclosed in U.S. Pat. No. 3,933,603 that in, using a trichamber-type electrolytic vessel of a similar kind as above, both intermediate and cathodic chambers are fed with water or aqueous low concentration caustic alkali solution, and the caustic alkali concentration in the intermediate chamber is set to a low value, so as to obtain a high current efficiency.

In the case of the present invention for the manufacture of high concentration caustic alkali, the purpose thereof can be surprisingly fulfilled by feeding no water or no aqueous component to the cathodic chamber of the trichamber-type electrolytic vessel, except during the starting stage of the electrolytic operation, resulting in improved current efficiency.

In order to accomplish a twin chamber style ion exchange membrane electrolytic process and in order to improve the electrolytic efficiency, therein it is necessary to exclusively convey selectively the alkali metal ions such as $Na^+$, $K^+$ and the like to the cathodic chamber, so as to convert, in the cathodic chamber, these ions into caustic alkali. When the concentration of the caustic alkali in the cathodic chamber becomes high, part of $OH^-$ -ions can move towards the anodic chamber by the unavoidable diffusion. The thus transferred $OH^-$ -ions give rise to oxidation at the anode or to undesirable reaction with other ions prevailing therein which invites an inferior current efficiency. Complete prevention of such transfer of $OH^-$ -ions could not be realized so far as nowadays available ion exchange membranes are used.

In the case of the filter diaphragm electrolysis, a large quantity of brine will flow from the anodic chamber towards the cathodic chamber, thereby checking the diffusion of $OH^-$ -ions towards the anodic chamber which would otherwise lower the current efficiency.

In the case of tri-chamber mode electrolytic process, the alkali metal ions passed through the ion exchange membrane arranged between and to separate the anodic and intermediate chambers will become caustic alkali in the intermediate or cathodic chamber, while only the $OH^-$ -ions which have passed through the same membrane will act in the anodic chamber to separate oxygen and the like gases, thereby inviting a substantial reduction of the current efficiency. Therefore, the current efficiency in this electrolytic bath in the entirety will be decided by the operating condition of the ion exchange membrane separating the anodic chamber from the intermediate chamber. Therefore, it is thus highly advantageous to keep the alkali concentration at low value, so as to improve the current efficiency of the said ion exchange membrane. Based upon such observation, it has already been proposed and brought into practice to feed water or aqueous caustic alkali solution to the intermediate and cathodic chambers, so as to produce in the former, low concentration caustic alkali, and to generate higher concentration caustic alkali in the cathodic chamber.

In the apparatus for carrying out the process according to this invention, there are again provided both intermediate and cathodic chambers, and when necessary, water or aqueous caustic alkali solution is fed to the intermediate chamber. The cathodic chamber is arranged so that the caustic alkali and/or water flow thereinto exclusively by the osmosis through the ion exchange membrane from the intermediate chamber. In this way, highly concentrated caustic alkali is formed in the cathodic chamber.

In the case of the electrolytic treatment of common salt solution with use of the tri-chamber mode ion exchange membrane electrolytic bath, the concentration of caustic soda solution prevailing in the intermediate chamber is determined, according to the following well known method, by the sum of the amount of caustic soda which is formed by the $OH^-$ -ions flowed from the cathodic chamber, less those further flowed away towards the anodic chamber, the thus resulted residual $OH^-$ ions reacting with $Na^+$ -ions prevailing in the intermediate chamber, (if the latter chamber be fed with caustic soda solution, the sum must be supplemented with the amount of caustic soda contained in the solution), and the quantity of water fed to the intermediate chamber. According to our information, however, it has been found that an appreciable amount of water passes through the ion exchange membrane and affects the alkali concentration prevailing in the intermediate chamber.

Based upon the above observation, we propose that one should not feed water or any aqueous solution including caustic alkali solution to the cathodic chamber since the formation of caustic alkali at the latter chamber depends exclusively upon such alkali metal ion and water which have transferred from the intermediate chamber and through the ion exchange membrane, so as to provide higher concentrated caustic alkali as possible. As a result of further experimentation, the above proposition has been shown to be true and a much higher concentration caustic alkali solution than expected has been obtained with an extraordinarily high current efficiency.

These and further objects, features and advantages will become more apparent when read the following detailed description of the invention with reference to the accompanying drawing, in which:

DETAILED DESCRIPTION OF THE INVENTION

Figure 1:
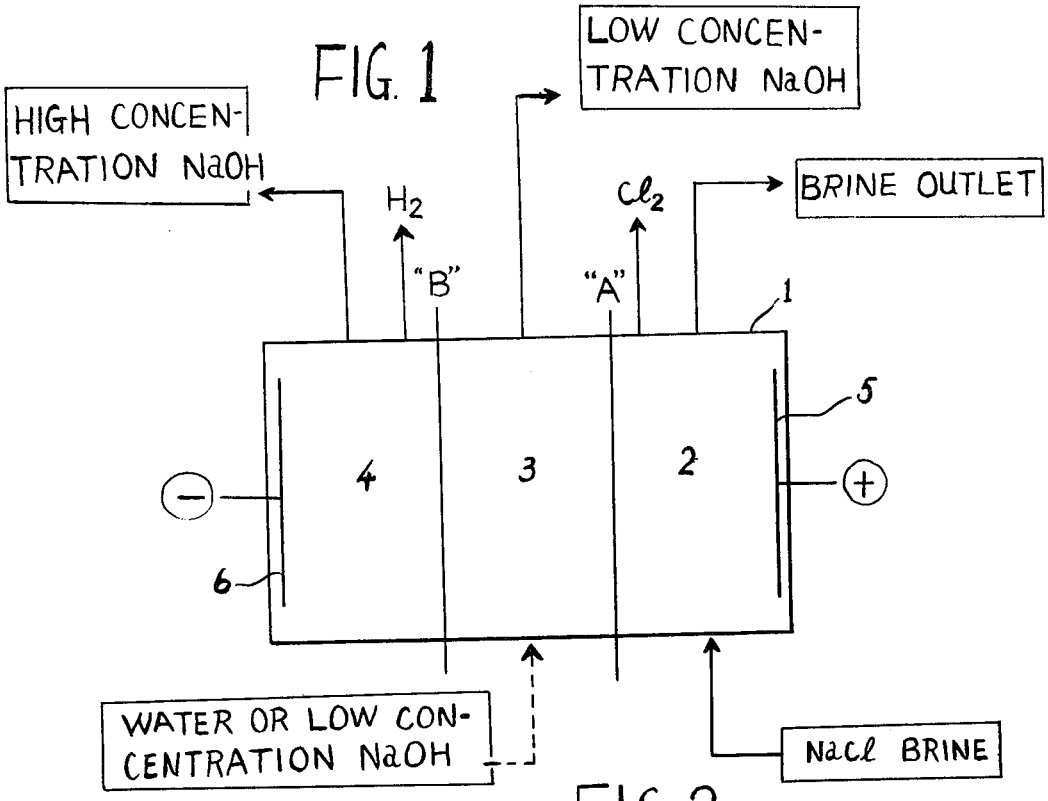
FIG. 1 is a schematic view of an electrolytic vessel assembly which is usable in the process according to this invention.
Figure 2:
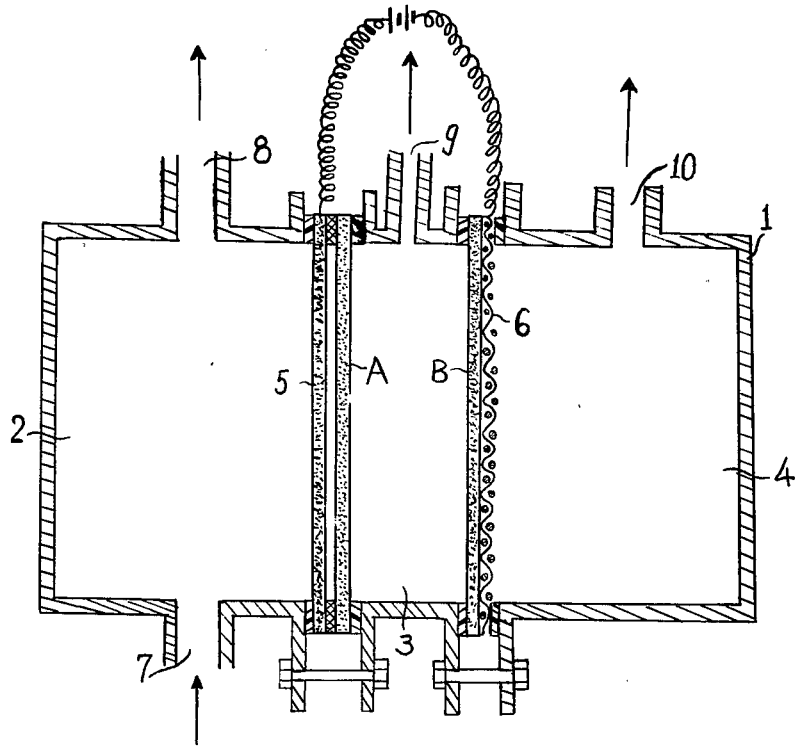
FIG. 2 is a schematic cross sectional view of the electrolytic vessel assembly shown in FIG. 1.

It is now assumed that the process is for the electrolytic treatment of NaCl solution, as an example. Percentages are given by weight, if not otherwise noted.

In the drawing, numeral 1 represents an electrolytic bath vessel assembly as an entirety. The assembly 1 comprises an anodic chamber 2, an intermediate chamber 3 and a cathodic chamber 4, arranged in series one after another. "A" and "B" represent ion exchange membranes which are isolated from the vessel walls. In the chambers 2 and 4, there are provided anode 5 (of metal) and cathode 6 respectively.

NaCl-brine is fed to the anodic chamber 2. The generated chlorine gas and the residual brine are taken out through respective outlets, as shown.

To the intermediate chamber 3, if necessary, water or low concentration aqueous NaOH-solution is fed, and low concentration NaOH, having a concentration of 5 - 25% is taken out through an outlet.

Only at the initial stage of operation is the cathodic chamber 4 fed with the necessary amount of caustic soda solution, thus no substance is fed thereto during operation of the device. With continued operation thereof, high concentration NaOH, having a concentration of 30 - 55%, and gaseous hydrogen are continuously generated in the chamber 4 and drawn therefrom through respective outlets as schematically shown.

The concentration of alkali halide brine which is fed to the anodic chamber 2 may be from 3% to saturation.

Ion exchange membrane "A" which separates the chambers 2 and 3 must preferably be of such performance as to have favorable current efficiency at the concentration prevailing in the intermediate chamber 3. It shows generally higher than 80% current efficiency at 5 - 25% concentration of caustic alkali.

The alkali concentration in the chamber 3 is maintained at 5 - 25%, and if necessary, water is supplied. With a lower concentration, a rise of electrical resistance could occur so and thus the concentration should be higher than 5%. With a concentration higher than 25%, it is very difficult to obtain a higher current efficiency than 80% for membrane "A".

In the tri-chamber process, even for an ion exchange chamber having a high current efficiency in the twin-chamber process, the current efficiency as calculated from the quantities of $Na^+$ -and $OH^-$ -ions passed through the membrane will become generally low providing a maximum current efficiency of 95%.

When water is supplied to the intermediate chamber 3, and the amount of caustic alkali generated therein is too small, and thus decreasing the flow rate below normal expectations, thus the flow rate appearing thereat being also too it is also possible to feed caustic alkali having a lower concentration than otherwise expected thereto.

In the common salt electrolysis, the concentration of aqueous NaCl-solution fed to the anodic chamber is generally a saturated one, being higher than 26%. If no water is fed also to the intermediate chamber, a low cncentration aqueous solution of less than 20% is used. The quantity of water which passes through the anodic side ion exchange membrane, to be called "membrane A" hereinafter, thus the aqua-quantity accompanied by $Na^+$ -and $OH^-$ -ions, depends mainly upon the current efficiency. Further, it depends upon the concentration of NaOH in the intermediate chamber and that of NaCl in the anodic chamber especially, when the latter concentration is adjustable and the concentration of NaCl in the anodic chamber is substantially lower in comparison with the concentration in the intermediate chamber, which means that the osmotic pressure is low enough, the membrane can pass enough quantity of water as necessary to the formed NaOH.

Although the ratio of that part of the current efficiency which depends upon the water transfer to that part depending upon the salt concentrations in the anodic and intermediate chambers has not yet been precisely measured, it seems to us that both may possibly have a mutually dependent relationship and can not be sharply separated from each other.

Anyhow, when the membrane is substantially free from pin holes and thus when there is no direct invasion of water from the anodic chamber to the intermediate one, it is very difficult to let enough water into the intermediate chamber through said menurone in an ion exchange electrolysis with almost saturated salt solution. The NaCl-concentration should therefore be less than 20 wt. %.

As an example, when one desire to produce a 50 wt. %-caustic soda solution while maintaining current efficiencies of 80%, 90% and 95%, the theoretically required of water will amount to 1.9 g/A.h; 2.0 g/A.H and 2.1 g/A.h, respectively. When 40 wt.%-caustic soda solution is to be produced with the above current efficiencies, the necessary amount of water will be about 2.5 g/A.h; 2.7 g/A.h and 2.8 g/A.h, respectively.

When the electrolytic treatment is carried out with use of the ion exchange membrane "NAFION" (registered trademark) adapted for the common salt electrolysis of common salt solution and manufactured and sold by E. I. DuPont De Nemours & Co., Inc., Wilmington 98, Del., and where said membrane is so arranged so as to define the separating wall between the anodic and intermediate chambers and where saturated common salt aqueous solution is fed to the anodic chamber, the osmotically transferred aqueous quantity will be about 2.0 g/A.h. Thus, it could be theoretically said mainly in light the osmotic performance of the membrane "A" that a caustic soda solution of higher concentration than 50 wt.% could be manufactured. But, in this case, the caustic soda transferred to the intermediate chamber must be further condensed in the cathodic chamber and, the thus resulting alkali concentration will be too much high to continue the process.

On the other hand and as will be later more fully described, the cathodic side ion exchange membrane (to be called membrane "B" hereinafter) must always have a lower osmotic performance than the membrane "A". Even if a membrane having less osmotic power than 2.0 g/A.h be procured, and when the difference is osmotic water quantity between the membranes is only small, a stabilized continuation of the electrolytic operation could not be guaranteed due to possible occurrence of clogging of membrane pores and deterioration of the membrane. Therefore, grave caution must be paid so as to increase the aqua-osmotic power of the membrane "A" by keeping the NaCl-concentration at a low level. If one complies with this condition, no problems should arise during an extended use of the whole electrolytic system, even if the membrane performance should be more or less lowered and/or the caustic soda concentration in the intermediate and cathodic chambers should be subjected to an appreciable change. In practice, however, we have set the NaCl-concentration at less than 20 wt.%, for the assurance of the continued and stabilized electrolytic operation. On the other hand, the lower limit of NaCl-concentration should be set by considering the possible increase of electric resistance value. In order to avoid an appreciable and disadvantageous increase in the electric resistance, we have set the lower limit generally at 2 wt. %.

When the aqua-osmotic quantity flowing through the membrane "A" is to great caustic soda solution produced may be too low in concentration. For example the amount of water required to obtain a 20 wt.%-caustic soda with a current efficiency of 95% will be about 6.3 g/A.h. When the salt concentration at the anodic chamber is kept higher than 2 wt.% and the ion exchange membrane has a performance of 10 - 30 A/dm$^2$ and substantially no pin holes, there would be no chance of osmotically passing too great a quantity of water through the membrane.

Furthermore, as for the membrane "A", should possess a small $OH^-$-ion passing ability and at least an 80% current efficiency in connection with NaOH. Thus it is preferable to use a membrane having as large a Na-ion exchange performance as possible.

When water is not fed to the intermediate chamber, the osmotic water quantity passing through the membrane "B" should be less than that passing through the membrane "A". If not, the NaOH-concentration in the intermediate chamber will become higher than that prevailing in the cathodic chamber and thus lessing the current efficiency at the membrane "A". Further, in this case, the operating condition is not suitable for the purpose of the manufacture of high-concentration and high purity caustic alkali. Further, under extreme conditions, the liquid quantity in the intermediate chamber will be reduced further than expected and gases will invade that chamber thereby causing an interruption of the continuous operation. In this case, therefore, water or low concentration caustic soda solution must be added to the intermediate chamber. Since the water contained in the caustic soda formed at the cathodic chamber is all fed through the membrane "B", the latter must naturally have a certain industrially allowable degree of aqua-osmotic performance. The preferable aqua-osmotic performance may be generally within the range of 1.3 - 4.0 g/A.h, while the current efficiency relative to the membrane should be higher than 50%.

As a further practical measure for carrying out the process according to this invention in an optimal way, the ratio of the alkali outcome produced in the cathodic chamber to the total caustic alkali produced in the intermediate and cathodic chambers can play an important role and may be called "selective rate". Further, the current efficiency at the membrane "B" may be expressed by the product of that measured at the membrane "A" and the selective rate at the membrane "B". The current density amounts generally to 10 - 30 A/dm$^2$.

It should be stressed that according to the process of the instant invention, the alkali concentration in the intermediate chamber and/or cathodic chamber can be held at a sufficiently high level. On the other hand, since all the necessary aqua-content or water is supplied from the cathodic chamber to the intermediate chamber exclusively through the ion exchange membrane, the quantity of $OH^-$-ions varies inversely from the cathodic chamber to the intermediate one must transfer in the counter flow condition relative to the aqua-component and thus be made to a rather lesser degree, thereby the selective rate at the membrane "B" being improved correspondingly. As a result, the relative ratio of caustic alkali quantity produced at the intermediate chamber to that produced at the cathodic chamber may be made correspondingly smaller. In this way, the desired high concentration caustic alkali can be obtained with a high operating efficiency.

In addition, since there is no need to feed water or aqueous alkali to the cathodic chamber, the structure of the latter may be rather simplified.

In a somewhat modified system which may have a rather complicated structure in the sense that an intermediate reservoir is additionally provided and placed at a position selected outside of the bath vessel assembly as shown, and further that an additional self circulation system is provided between the cathodic chamber and the newly provided intermediate reservoir for the caustic alkali formed at the cathodic chamber. This modification will increase the transfer speed of the formed caustic soda within the cathodic chamber, thereby providing a means to separate the gaseous hydrogen formed at the cathode more easily By adopting this measure, the bath operating voltage can be correspondingly lowered. Such case as mentioned above, may be included within the spirit and gist of the present invention, since it can be safely said that the cathodic chamber is deemed as being fed with such a liquid which exclusively comprises the water and metal ions which have passed through the ions exchange membrane under consideration.

An ion exchange membrane is safely usable in the present inventive process where such membrane is composed of a chemically durable framework of highly crosslinked polymer bears, at a highly condensed state, anodic ion exchangeable groups, such as for instance, sulfonic acid-carboxylic acid- and/or phenolic radicals.

Usable polymers include crosslinked acrylic acid resin and/or crosslinked methacryl acid resin (employing as crosslinking agent, divinyl benzene, trivinyl benzene or the like); sulfonated styrene/divinylbenzene copolymer; sulfonic acid radical-bearing, fluorine-containing resins; hydroxystyrene polymer and various graft polymers.

Materials adapted for the preparation of the membrane "A" which must have a high chemical resistance, and as especially acid-proof and alkali-proof performance, are various fluorine-containing resins. As an example, polymers or copolymers of such monomers as ethylene tetrafluoride; propylene hexafluoride; ethylene chloride trifluoride; ethyl trifluoride, vinylidene fluoride; and $\alpha$, $\beta$, $\beta$ -styrene trifluoride may be employed.

Their structure may be expressed by:

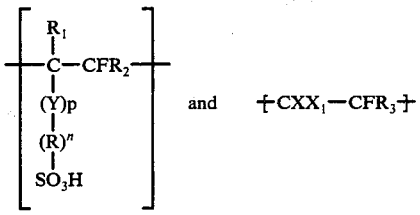

where R represents a structural unit of $+O-CR_4R_5-CR_6R_7)_m$, $R_1$; $R_2$; $R_3$; $R_4$; $R_5$; $R_6$ and $R_7$ represents perfluoroalkyl radicals, each having 1 - 10 fluorine or carbon atoms. Further, Y stands for a perfluoroalkylene radical of $C_1$ - $C_{10}$. In addition, $m = 0, 1, 2$, or 3; $n = 0$ or 1; $p = 0$ or 1; X stands for fluorine chlorine, hydrogen or trifluoromethyl. $X_1$ stands for X or $CF_3(CF_2)_q$ where $q$ being zero or 1 - 5. This type of copolymer is being manufactured and sold by the said corporation E. I. DuPont under the trade name of "NAFION" as was referred to above. The introduction may also be carried out by reaction. As an example, sulfonic acid radical may be introduced into the polymer having vinylidene fluoride unit. Sulfonic acid radical may be introduced at the benzene ring by reaction.

The styrene monomer, acrylic acid monomer or the like may be subjected to a graft polymerization so as to graft to the original polymer, and then further subjected to sulfonation, hydrolysis and the like, so as to introduce ion exchange radical into position. The sulfonation product of perfluorostyrene may be used advantageously as the material for the anti-chemical membrane usable in the process according to this invention.

On occasion, however, a membrane having practically no anti-chlorine performance may be used for the purpose of the present invention. In this case, it is advisable to provide a neutral filter membrane in close proximity to the anode and to feed the brine into the space defined by and between the ion exchange membrane and the newly provided filter membrane. Therefore, the usable membranes should not limited to those which are made of fluorine-containing resin or resins. Since the membrane is practically not in contact with chlorine. Thus, the material selection can be made mainly by the consideration of alkali proof performance.

As may be concluded from the foregoing description, the present invention provides an improved process for providing both low and high concentration caustic alkali at a high electric current efficiency greater than 80% with high operating efficiency to provide high concentration which means a substantial progress in the art.

Now follow, several preferred examples given in a non-limiting sense and only for a better understanding of the present improved process. In these examples, percentages will be given by weight, if not otherwise noted.

EXAMPLE 1

The electrolytic bath assembly used in the experiment was same as shown in the attached drawing.

The anode is shown at 5 and the ion exchange membrane "A" are arranged between the anodic and intermediate chambers. The cathode 6 and ion exchange membrane "B" are arranged between the cathodic and intermediate chambers, so as to define the related chambers. The anodic chamber 2 is formed with brine inlet 7 and outlet 8. From the latter, return brine and chlorine are discharged.

The intermediate chamber 3 is formed with diluted caustic soda outlet 9. The cathodic chamber 4 is formed with an outlet 10 adapted for discharging both high concentration caustic soda and gaseous hydrogen. The anode 5 is made of titanium coated with ruthenium oxide. The cathode 6 is made of steel net.

The ion exchange membrane "A", "NAFION 315" which is a composite membrane prepared by "NAFION EW-1100" membrane element, "NAFION EW-1500" membrane element and a mesh sheet of ethylene tetrafluoride resin element.

With respect to the membrane "B", the preferable material can be prepared from a copolymer of methyl acrylate, divinyl benzene and styrene and treated with chlorosulfonic acid for sulfonation. The electrolytic material is NaCl.

6% aqueous NaCl solution is fed to the anodic chamber and the electrolytic treatment is performed with a current density of $20A/dm^2$.

At the beginning stage of the electrolysis, 10%- and 30%-aqueous NaOH solutions are fed respectively to the intermediate and cathodic chambers. Upon realization of steady concentration of each of said solutions in the respective chambers, the electrolytic conditions are measured:

Table 1

| | |
|---|---|
| anode | titanium-ruthenium; |
| cathode | iron net; |
| interelectrode distance | 5 mm; |
| brine | 6% aqueous NaCl solution; |
| bath temperature | 80° C; |
| current density | $20A/dm^2$; |
| bath voltage | 3.9 V; |
| liquid in intermediate chamber | |
| concentration of NaOH | 15%; |
| concentration of NaCl | 300 ppm; |
| liquid in cathodic chamber | |
| concentration of NaOH | 42%; |
| concentration of NaCl | 50 ppm; |
| current efficiency | 84%; |
| water quantity osmotically passed through membrane "A" | 3.6 g/A · h; |
| water quantity osmotically passed through membrane "B" | 1.7 g/A · h; |

EXAMPLE 2

The same apparatus is used as in the foregoing Example 1. Membrane "A", a composite comprising "NAFION FW-1500"; "BW-1100" and ethylene tetrafluoride resin mesh is used. As the membrane "B", a composite one comprising "NAFION 425" membrane is used NaCl is used and to electrolyse. 6%-aqueous NaCl solution is fed to the anodic chamber; no liquid is supplied to the cathodic and intermediate chambers. The results are shown in Table 2. Current density: 20 $A/dm^2$.

Table 2

| | |
|---|---|
| anode | titanium-ruthenium; |

Table 2-continued

| | |
|---|---|
| cathode | iron net; |
| interelectrode distance | 5 mm; |
| brine | 6% NaCl solution; |
| bath temperature | 80° C; |
| current density | 20A/dm²; |
| bath voltage | 4.2 V; |
| liquid in intermediate chamber | |
| concentration of NaOH | 11.3%; |
| concentration of NaCl | 300 ppm; |
| liquid in cathodic chamber | |
| concentration of NaOH | 35.2%; |
| concentration of NaCl | 95 ppm; |
| current efficiency | 85%; |
| water quantity osmotically passed through membrane "A" | 3.77 g/A · h; |
| water quantity osmitically passed through membrane "B" | 2.78 g/A · h; |

EXAMPLE 3

The same apparatus as is used in the foregoing Example 1. As the membrane "A", "NAFION 315" is used. Membrane "B", is formed by impregnating butyl metacrylate 50 wt.% and divinyl benzene 50 wt.% in a Teflon paper sheet and subjected to polymerization in a nitrogen atmosphere with use of benzoyl peroxide as catalyst and then treating the shaped polymer-paper product in sulfuric acid. As the anodic liquor, 18%-aqueous NaCl solution is used. The electrolytic conditions are as shown in the following Table 3.

Table 3

| | |
|---|---|
| anode | titanium-ruthenium; |
| cathode | iron net; |
| interelectrode distance | 5 mm; |
| brine | 18% NaCl solution; |
| bath temperature | 80° C; |
| current density | 20 A/dm² |
| bath voltage | 4.2 V; |
| liquid in intermediate chamber | |
| concentration of NaOH | 5.2%; |
| concentration of NaCl | 300 ppm; |
| liquid in cathodic chamber | |
| concentration of NaOH | 42.2%; |
| concentration of NaCl | less than 50 ppm; |
| current efficiency | 85.5%; |
| water quantity osmotically passed through membrane "A" | 2.9 g/A · h; |
| water quantity osmotically passed through membrane "B" | 2.37 g/A · h; |

When the electrolysis was continued, it was found that the liquid level in the intermediate chamber decreased gradually, while the operating voltage rose rather suddenly. The liquid temperature increased abruptly and then finally, the current passage was interrupted.

Then, in order to measure the quantity of water of osmotically passed through the ion exchange membrane, a 26%-aqueous NaCl-solution was fed to the anodic chamber and the electrolysis was reinitiated. Water was also supplied to the intermediate chamber. For this purpose, the electrolytic device used in the present experiment had been so modified to provide a water inlet to the intermediate chamber.

The osmotically passed water quantities through the membranes "A" and "B" were then measured. The results were:

2.18 g/A.h for membrane "A";

2.29 g/A.h . . . for membrane "B".

Operating voltage was 4.2 V. Current efficiency was 79%. NaOH-concentrations at the intermediate and cathodic chambers were 4.0% and 41.8%, respectively. These values are deemed somewhat different from those as obtainable with no water supply to the intermediate chamber. However, it is observed in this case that the osmotic water quantity that passed through the membrane "B" is larger than that in the chamber "A". This fact corresponds to the above experiment where no water was fed to the intermediate chamber and the liquid quantity prevailing therein was appreciably reduced.

EXAMPLE 5

Two membrane sheets of "NAFION-315" were used in this case as the ion exchange membranes for the electrolytic purpose. Each of these membranes consists of a laminated composition of "EW-1500" and "EW-1100", of which the "EW-1500" membrane element was directed towards the cathode.

A brine consisting of about 26%-NaCl brine was fed to the anodic chamber so as to obtain a waste bring having a concentration of about 24%. The current density adopted was 20 A/dm². The results are shown in Table 4.

It will be seen thus from the foregoing that even while using the same kind of membrane, but operating in accordance with the instant inventive process, a highly superior current efficiency can be attained with a NaOH solution of a concentration greater than 30%.

Table 4

| No. | Conc. at Intm. Cham., % | Conc. at Cath. Cham., % | Current Eff. at Membrane "A" relative to NaOH, % | Water Transfer from Intm. Cham. to Cathod. Cham., g/A · h | Relative to Membrane "B" Sel. Ratio, % | Relative to Membrane "B" Cur. Eff., % |
|---|---|---|---|---|---|---|
| 1 | 9.6 | 30.9 | 84 | 3.42 | 98.5 | 82.7 |
| 2 | 14.4 | 35.8 | 80.4 | 2.70 | 94 | 75.6 |

Table 5

| Conc. at Intm. Cham., % | Conc. at Cath. Cham., % | Current Eff. at Membrane "A", % | Water Transfer from Intm. Cham. to Cathod. Cham., g/A · h | Relative to Membrane "B" Sel. Ratio % | Relative to Membrane "B" Cur. Eff., % |
|---|---|---|---|---|---|
| 21.3 | 48 | 84 | 2.15 | 76 | 63.8 |

EXAMPLE 4

The apparatus is the same as before. The concentration of the introduced NaCl is set to 26%.

Table 6

| No. | Conc. of NaCl Brine, % | Conc. at Cath. Cham., NaOH(%) | Cur. Eff., % |
|---|---|---|---|
| 1 | 26 | 20 | 80 |

Table 6-continued

| No. | Conc. of NaCl Brine, % | Conc. at Cath. Cham., NaOH(%) | Cur. Eff., % |
|---|---|---|---|
| 2 | 10 | 19 | 81 |
| 3 | 10 | 30 | 70 |

EXAMPLE 6

The apparatus now used is fitted with a liquid inlet at the intermediate chamber, as in the same manner disclosed in the foregoing Example 3.

50 parts of butyl metacrylate, 50 parts of divinyl benzene (56%, the remainder being mainly ethyl vinyl benzene) and 1 part of benzoil peroxide were mixed well together and impregnated in a polytetra ethylene fine pore member (Polyflon PA-5L, manufactured by Daikin Kogyo K.K., of Osaka). Then, the impregnated product was heated in a nitrogen atmosphere to execute polymerization and finally, treated for two weeks in a sulfuric acid bath of 98% acid concentration, so as to provide a sheet of the ion exchange membrane "B" (see, FIG. 1).

Then, for the preparation of the membrane "A" (see, FIG. 1), "NAFION 315" was dipped in a bath containing 30%(ZrO)Cl.$H_2O$ solution at room temperature for 10 hours, dipped in a second bath containing 95%-ortho-phosphoric acid at room temperature for 30 minutes, washed well with fresh water and then dried at 110° C for 2 hours. As the brine, unaqueous soltion of NaCl about 26% was used. The intermediate chamber was fed with 15%-aqueous NaOH-solution for initiating the electrolytic treatment. The results are seen in Table 5.

The membrane "B" used in the present experiment showed a current efficiency of about 60% at the cathodic chamber concentration of 20% in a twin-chamber mode experiment with use of about 26%-NaCl-brine. Thus, a substantially superior current efficiency was attained.

COMPARISON EXPERIMENT

"NAFION-315" was used to prepare the membranes. The electrolysis was performed in the twin chamber mode and 26%- and 10%-NaCl aqueous solution were used for the experiment. The results are shown in the foregoing Table 6.

In the electrolysis using NAFION-316 as the membrane material and with the cathodic chamber concentration kept at about 20%, the current efficiency is about 80%. Even if, in this case, the brine concentration should be adjusted to a substantially diluted value, the current efficiency will be about 70% or so at the maximum.

We claim:

1. In a process for the electrolytic treatment of alkali halide in an electrolytic bath having an anodic chamber, an intermediate chamber and a cathodic chamber arranged in succession and separated from one another by an ion exchange membrane so as to provide low concentration caustic alkali solution from the intermediate chamber and high concentration caustic alkali solution from the cathodic chamber, the improvement comprising selecting said ion exchange membranes so that the membrane arranged between the anodic and intermediate chambers has a higher water penetration capability than that of the membrane arranged between the intermediate and cathodic chambers, the latter membrane having a water penetration capability of from about 1.3–4.0 g/A.h, and forming the high concentration caustic alkali solution in the cathodic chamber without the direct addition of any water to said cathodic chamber, said high concentration caustic alkali solution being produced exclusively from the metal ions and the water which have passed from said intermediate chamber through the ion exchange membrane into said cathodic chamber.

2. The process of claim 1 wherein caustic alkali solution having a concentration of 5–25% is withdrawn from said intermediate chamber.

3. The process of claim 2 wherein caustic alkali solution having a concentration of 30–55% is withdrawn from said cathodic chamber.

4. The process of claim 3 wherein an alkali halide solution having a concentration of less than 20% is fed to said anodic chamber.

5. The process of claim 1 wherein the ion exchange membranes are cationic selective.

6. The process of claim 1 wherein water or low concentration caustic alkali aqueous solution is fed directly into the intermediate chamber.

* * * * *